United States Patent [19]

Pettis

[11] Patent Number: 4,644,589

[45] Date of Patent: Feb. 24, 1987

[54] SELF ADMINISTRABLE GARMENTS FOR ARTHRITIC PERSONS

[76] Inventor: Mary J. Pettis, 2420 Olson St., Temple Hills, Md. 20748

[21] Appl. No.: 698,441

[22] Filed: Feb. 5, 1985

[51] Int. Cl.[4] ..... A41B 9/00

[52] U.S. Cl. ..... 2/109; 2/403; 2/114; 2/DIG. 7

[58] Field of Search ..... 2/114, 109, DIG. 7, 2/DIG. 6, 102, 115, 113, 405, 403

[56] References Cited

U.S. PATENT DOCUMENTS

| | | | |
|---|---|---|---|
| 1,130,216 | 3/1915 | Thayer | 2/113 |
| 3,490,072 | 1/1970 | Keltner | 2/114 |
| 3,997,982 | 12/1976 | Holland | 2/102 |
| 4,145,763 | 3/1979 | Abrams et al. | 2/403 |
| 4,530,349 | 7/1985 | Metzger | 2/102 |

*Primary Examiner*—Doris L. Troutman
*Attorney, Agent, or Firm*—Richard C. Litman

[57] ABSTRACT

A self donning garment for use of a person with limited movement of his arms or legs. The garment in one preferred embodiment comprises a shaped undergarment which has been vertically split along the frontal midline and has, applied to the opposed central edges of the split segments, a pressure actuated fastener means.

The wearer, laterally in sequence, slips first one arm or leg into one aperture of one segment, then the other one. He then draws the two together along the frontal midline and pressure fastens the same.

10 Claims, 4 Drawing Figures

SELF ADMINISTRABLE GARMENTS FOR ARTHRITIC PERSONS

BACKGROUND OF THE INVENTION

A. Field of the Invention

Many people who are partially incapacitated by reason of age, senility, arthritis, or other ailments which restrict either their movement of their limbs or appendages, have difficulty in dressing themselves. To these persons, relatively simple tasks such as donning an underwear top which must be slipped on over the head and shoulders of the wearer, is either painful or incapable of achievement.

These persons frequently live alone with no one to aid them in daily morning dressing or rearrangement of their clothing after a trip to the bathroom or shower. Many of these people, in fact, wear no undergarments because they are in fact unable to put these on and take them off without assistance.

B. Prior Art Found in the Field of Invention

A United States Patent issued to Raymond Keltner in 1970, bearing U.S. Pat. No. 3,490,072 on a medical gown for patients which can be easily placed on the patient by hospital attendants. With the use of this Keltner gown, the patient who may be unconcious is placed in a supine position with the gown underneath him or her. The patient's arms are placed through the arm apertures and the straps going over the shoulder are fastened by VELCRO® fasteners or other means. Then the garment is fastened above the front dorsal midline to bring together the two lateral panels.

When the garment is to be removed, the reverse actions are applied except that the patient need not be in a supine position.

This garment works fine where either the patient is able to reach and unfasten the snap fasteners located on top of each shoulder or has a hospital attendant available to do so. But the elderly arthritic person living alone is just as trapped in this garment as he would be in ordinary underwear.

It is an object of the present invention to describe a garment which can be put on easily by a single person who cannot elevate his arms above a horzontal plane or even less than this level. The same can be said for a person who has severe limitations on the mobility of his legs, yet wishes to himself put on and take off his own underpants to go to the bathroom without assistance of others.

GENERAL DESCRIPTION OF THE INVENTION

Accordingly, the present invention comprises a self donning or adminstrable garment either outerwear or underwear, but a garment, preferably underwear, which one, usually while standing, can easily put on one's self about one's body portion and, also usually while standing, allow it to be removed by a single wearer who has limited use of his or her arms and/or legs.

Referring to the attached drawing, one observes the garment to comprise a flexible fabric consisting of a superior shoulder straps 1 and 1', which extend over each shoulder and a laterally opposed pair of arm apertures 2 and 2' through which the arms of the wearer are slipped in sequence. The garment has a right and left frontal panel 4 and 5, each of which has a vertical centrally located leading edge 6 and 7.

Each of these leading edges has a pressure sensitive fastener strip 8 and 9 attached in an opposed relation with one strip positioned on the external face of the garment panel, the other positioned on the internal face of the panel. An example of a pressure sensitive pressure strip is a VELCRO® fastener.

DESCRIPTION OF THE PREFERRED EMBODIMENTS OF THE INVENTION

Figure 1:
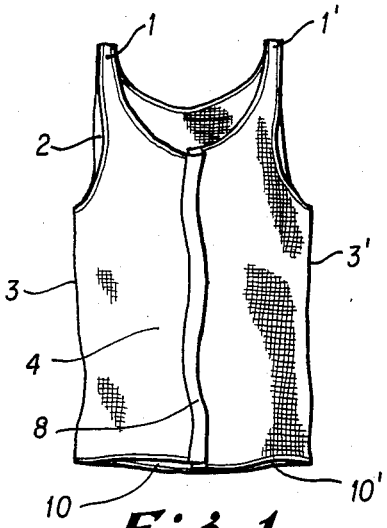
FIG. 1 of the drawing comprises a perspective plan view of the garment top fastener prior to use.
Figure 2:
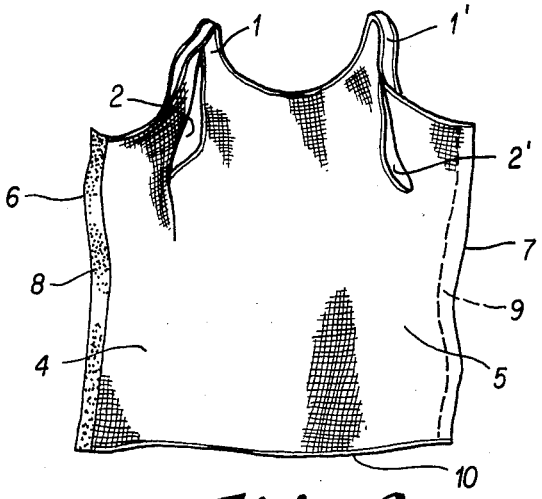
FIG. 2 is a front and right side view of a male version top of the undergarment on the wearer before fastening.

Referring then to FIGS. 1 and 2 of the drawing, it can be seen that the wearer dons the garment by placing first his right arm through the right lateral arm aperture 2 and then through the left lateral arm aperture 2', so that right superior shoulder strap 1 and left superior shoulder strap 1' are supporting the same. This insertion is made in both instances by the wearer using his own hands and not elevating either arm above a horizontal plane. The right exterior lateral edge 3 of the garment now rests flat against the right side of the wearer and likewise, the left exterior lateral edge 3' lies flat against the left side of the wearer. The right frontal garment panel 4 lies flat against the front right chest wall of the wearer while the left frontal garment panel 5 lies flat against the left front chest wall of the user.

With his right or left hand, the wearer now draws together the two panels 4 and 5 until their central leading edges 6 and 7 are in opposed register. At this point, the wearer exerts compressive pressure on the internal pressure sensitive male fastener strip of 8 of the right frontal panel leading edge 6 to affix it to its opposed external female pressure sensitive fastener strip 9 to hook the garment panels together.

Figure 3:
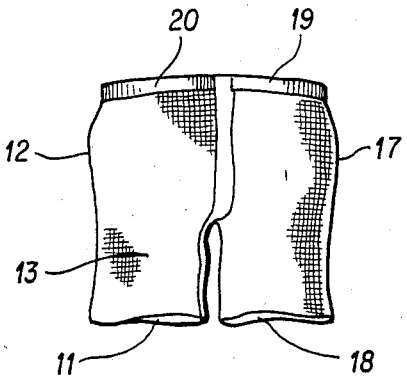
FIG. 3 is a front and right side view of a male version bottom of the undergarment on the wearer after fastening.
Figure 4:
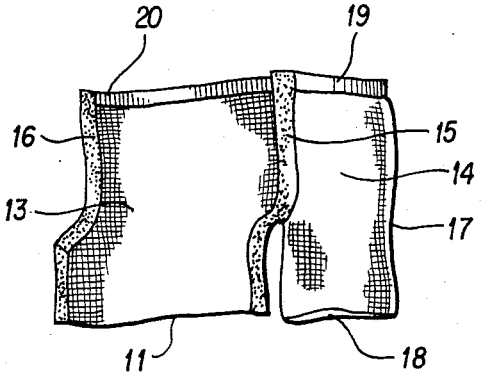
FIG. 4 is a front view of a male version of the bottom of the undergarment before fastening the central pressure sensitive means.

Referring now to FIGS. 3 and 4, it can be seen that the wearer dons the garment by the right leg aperture 11 being opened up by the swing back of right panel 13 along right lateral edge 12 to expose the opening of the left panel 14 and its left lateral edge 17 and left leg aperture 18. The left leg of the wearer is then inserted through the aperture 18 and the right panel 13 pulled into register with the left panel 14. The right exterior lateral edge 12 of the garment now rests flat against the right side of the wearer and likewise, the left exterior lateral edge 17 lies flat against the left side of the wearer. The right frontal garment panel 13 lies flat against the front right body surface of the wearer while the left frontal garment panel 14 lies flat against the left front body surface of the user.

With his right or left hand, the wearer now draws together the panel 13 toward 14 until the central leading edges 15 and 16 are in opposed register. At this point, the wearer exerts compressive pressure on the internal pressure sensitive male fastener strip of 15 of the right frontal panel leading edge to affix it to opposed external female pressure sensitive fastener strip of 19 to hook the garment panels together. Thus the male VELCRO fastener strip 15 of the left panel 14 is brought into an opposing overlap position with the female VELCRO fastener strip 16 of the right panel 13.

In this manner it can be seen in FIGS. 1 through 4 that the right inferior leading edge 10, 11 of the garment is matched up with the left inferior edge 10', 18 of the same to complete the donning of the garment by the wearer without any assistance from any other party. FIGS. 3 and 4 of the drawing illustrate the inventive concept to so called "boxer shorts" and it can be noted that the right leg aperture 11 is opened up by the swing back of right panel 13 along right lateral edge 12 to expose the opening of the left panel 14 and its left lateral edge 17 and the left leg aperture 18. The left leg of the wearer is then inserted through the aperture 18 and the right panel 13 pulled into register with left panel 14. The male VELCRO fastener strip 15 of the left panel 14 is brought into opposing overlap position with the female VELCRO fastener strip 16 of the right panel 13. The right superior leading edge 20 of the right panel 13 is brought into matching relation with the left superior leading edge 19 of the left panel 14 by compression of the central VELCRO fastener strips 15 and 16.

Although the invention has been illustrated by reference to the construction of male underwear garments, it must be understood that it could also be employed with reference to female underwear garments as well and also applied to both male and female outerwear garments.

The aforesaid description of the preferred embodiments of the present invention are not intended to imply in any manner a limitation on the scope of the present invention. For a proper legal definition of the scope of the invention, reference may be made only to the several appended claims.

I claim as my invention:

1. A self-donning garment for a wearer who may be a partially crippled or arthritic person who has restricted limb movement of some limb members of one's body and in which the garment has left and right oriented wearing portions disposed about an axis positioned about the garment and defined as generally centrally of and parallel with a locus of the left and right portions thereof and the axis extending generally in a vertical direction should the wearer be standing and in which the garment comprises in combination a single layer of flexible fabric material having a pair of laterally opposed apertures for providing insertion of at least one of the wearers limb members and for thereupon enveloping at least a portion of the body, a pair of opposed leading edges on the flexible fabric material of the garment positioned vertically of the garment midway between the locus of the pair of laterally opposed apertures and the edges extending from an upper border of the garment to a lower border thereof, a pair of laterally opposed apertures formed of the layer of flexible fabric material but in which one of the apertures provides for a reception of and insertion of at least one of the wearer's limb members including one portion of the material thereupon enveloping at least one portion of the body and in which the other of the apertures is formed of another portion of the material adapted to swing around another portion of the body and thereupon enveloping at least a further and generally contiguous other portion of the body, and a fastening means positioned generally parallel to the axis of the garment and enveloping at least a portion of the body consisting essentially of a thin strip of compressive pressure sensitive fastening material positioned generally parallel to the axis and on the external face of one of the pair of opposed leading edges and on the internal face of the other member of the pair of opposed leading edges, each overlapping in fastener secured relation and the fastening means being fastenable by the wearer without the necessity of the wearer elevating the wearer's limb member above a plane defined as generally horizontal to the location of the limb member having restricted limb movement.

2. A method for self-donning a garment by a partially crippled or arthritic person having a body with limb members who has restricted limb movement of an affected limb member not capable of elevation above a generally horizontal level of a highest location of the affected limb member and which method comprises positioning a selected one of the limbs into an aperture formed of one portion of a layer of flexible fabric material of the garment without elevating the affected limb member and the material of the aperture enveloping a portion of the body, swinging another portion of the layer of flexible fabric material of the garment around and about another portion of the body without elevating the affected limb member and thereby forming another aperture formed of the other portion of the layer of flexible fabric material and so forming a pair of laterally opposed apertures having a pair of opposed leading edges on the material positioned vertically of the garment midway between a locus of the pair of laterally opposed apertures and the edges extending from an upper border of the garment to a lower border thereof, bringing into register fastening means on the pair of opposed leading edges of the garment, and compressing into an external face of one leading edge against an internal face of the other to fasten the two leading edges in an interlocking relationship so the garment is now completely self-donned and ready to wear.

3. A garment according to claim 1 wherein the pressure sensitive fastening means is a VELCRO ® fastener combination of hooks and loops.

4. The garment of claim 1 wherein the fastener means are positioned in the front of the garment.

5. The garment of claim 1 wherein the fastener means are positioned on the side or sides of the garment.

6. The garment of claim 1 further characterized by the garment being an undergarment.

7. The method according to claim 2 wherein the pressure sensitive fastening means is a VELCRO combination of hooks and loops.

8. The method according to claim 2 wherein the fastening means are positioned in the front of the garment.

9. The method according to claim 2 wherein the fastening means are positioned on the side or sides of the garment.

10. The method according to claim 2 further characterized by the garment being an undergarment.

* * * * *